US007329109B2

(12) United States Patent
Lifson

(10) Patent No.: US 7,329,109 B2
(45) Date of Patent: Feb. 12, 2008

(54) OIL RETENTION IN SCROLL COMPRESSOR PUMP MEMBERS

(75) Inventor: Alexander Lifson, Manlius, NY (US)

(73) Assignee: Scroll Technologies, Arkadelphia, AR (US)

( * ) Notice: Subject to any disclaimer, the term of this patent is extended or adjusted under 35 U.S.C. 154(b) by 100 days.

(21) Appl. No.: 11/131,883

(22) Filed: May 18, 2005

(65) Prior Publication Data

US 2006/0263226 A1 Nov. 23, 2006

(51) Int. Cl.
*F04C 18/00* (2006.01)
*F04C 2/00* (2006.01)

(52) U.S. Cl. ..... 418/55.6; 418/55.1; 418/99; 184/6.18

(58) Field of Classification Search ..... 418/55.1–55.6, 418/57, 99; 184/6.16–6.18
See application file for complete search history.

(56) References Cited

U.S. PATENT DOCUMENTS 4,561,832 A * 12/1985 Shimizu ..... 418/55.4
6,149,413 A * 11/2000 Lifson ..... 418/55.5
6,354,822 B1 3/2002 Lifson
RE39,346 E * 10/2006 Lifson ..... 418/55.5

FOREIGN PATENT DOCUMENTS

EP 911526 A1 * 4/1999
EP 967392 A1 * 12/1999
JP 56056991 A * 5/1981
JP 59185892 A * 10/1984
JP 10339285 A * 12/1998
JP 2000009064 A * 1/2000

* cited by examiner

*Primary Examiner*—Theresa Trieu
(74) *Attorney, Agent, or Firm*—Carlson, Gaskey & Olds

(57) ABSTRACT

Oil retention recesses are formed on either or both orbiting and non-orbiting scroll elements. In one embodiment, the recesses are formed in a tip of a wrap of at least one of the scroll members. In another embodiment the recesses are formed on the base of at least one of the scroll elements. The recesses ensure that a sufficient quantity of oil is captured within the recesses to provide the lubrication into the interfacing surface of these elements. The recesses help, after a compressor is shutdown for long periods, to provide as lack of lubricant between the engaged scroll elements upon compressor start up. Other events may also cause momentary loss of oil supply at the compressor, such as, for example, compressor flooding. The recesses also help during intermittent interruption of oil delivery or when the amount of oil circulation is less than desirable.

13 Claims, 2 Drawing Sheets

OIL RETENTION IN SCROLL COMPRESSOR PUMP MEMBERS

BACKGROUND OF THE INVENTION

One type of modern refrigerant compressor is a scroll compressor. In a scroll compressor, a pair of scroll members each include a base and a generally spiral wrap extending from the base. The wraps interfit to define compression chambers. One of the two scroll members is caused to orbit relative to the other. As the two orbit relative to each other, there is a force at a rubbing interface between these two scroll members. One of the types of the interfaces between the scroll compression members is the interface between the base and wrap tips of the opposing scroll members. If there is not enough lubrication provided in the interface between these two members, it can lead to scroll element damage. Thus, during operation of a scroll compressor it is important to have a film of lubricant in the interface between the two scroll members. This application relates to a unique way of maintaining a small amount of lubricant in an orbiting and non-orbiting scroll elements interface to provide enhanced lubrication for a compressor during a starved lubrication on start-up or during continuous operation.

Sealed compressors are a part of refrigerant compression systems. A refrigerant system includes a number of components. Refrigerant flow lines connect the system components, and the refrigerant flows between the compressor and other components within the system such as the condenser, the evaporator and the expansion device, etc. At the same time, lubricant carried by the refrigerant also flows between the system components.

Often after shutdown of the system, the residual lubricant that remains inside the scroll compressor elements, such as orbiting and non-orbiting scroll, can drain from these elements. If sufficient amount of lubricant is missing from the orbiting and non-orbiting scroll interface then compressor damage can result when the scroll elements begin to rub against each during operation. This situation becomes particularly acute for a compressor that was shutdown for long periods, as lack of lubricant between the engaged scroll members can lead to the damage of these members upon compressor start up, before the sufficient amount of lubricant has been delivered to the scroll elements after the compressor started its operation. Other events occurring during operation of the refrigerant cycle may also cause momentary loss of oil supply at the compressor. This event can include compressor flooding, when the liquid refrigerant entering the scroll compressor elements can wash away the lubricant inside the scroll compressor pumping elements. Another event includes a situation when there is an insufficient amount of oil circulating through the scroll compressor pumping elements, in other words the scroll compressor elements are starved of sufficient amount of oil in the interface of the scroll compressor pumping elements. During the starved lubricant condition there is little or no lubricant in the interface, thus damage can quickly occur.

U.S. Pat. No. 6,354,822 discloses a method of preventing a starved lubricant condition between a slider block and an eccentric pin in a scroll compressor. However, there has been no similar provision to provide oil to the interface between the two scroll elements.

SUMMARY OF THE INVENTION

In disclosed embodiments of this invention, at least one of the orbiting and non-orbiting scroll members is provided with a lubricant retention feature. In one of the disclosed embodiments, oil retention recesses are formed in the wrap of one of the scroll members. The oil retention recesses are structured such that oil will remain in the recesses for substantial period after the compressor shutdown. as well as during a loss or limited oil supply during the compressor operation. That is, the recesses extend into the surface of the wrap tip. Alternatively, the recesses can be formed in the base of the scroll members.

Preferably, the retention recesses are deeper than the oil film thickness by an order of magnitude. In this way, oil is retained in the recesses such that there will be sufficient lubricant to form a thin lubricant film between the scroll members during oil-starved operation or at start-up, should start-up occur after the compressor has been shutdown for a significant period and if not for the recesses oil could have been removed from the orbiting and non-orbiting scroll interface. To that end, the recesses preferably have a depth between 0.2 and 2.0 millimeters. The term "recess" is used in this application to include any structure or groove. In preferred embodiments, there are actually a plurality of indentations having a diameter between 2 and 6 millimeters. However, recesses having a shape other than circular can also be utilized.

The scroll wrap is preferably either of a so-called "hybrid" shape, having a non-uniform cross-sectional area or having wraps of sufficient thickness. This allows the recesses to be preferably formed at a thick portion of the wraps, such that there is sufficient room to receive the recesses. Also, if the recesses were formed on the base of one of the scrolls, the thick wraps would prevent the refrigerant to leak over the recesses.

In sum, the recesses supply lubricant to the interface between the orbiting and non-orbiting scroll members, preventing damage to the scroll elements.

These and other features of the present invention can be best understood from the following specification and drawings, the following of which is a brief description.

DETAILED DESCRIPTION OF THE PREFERRED EMBODIMENT

Figure 1:
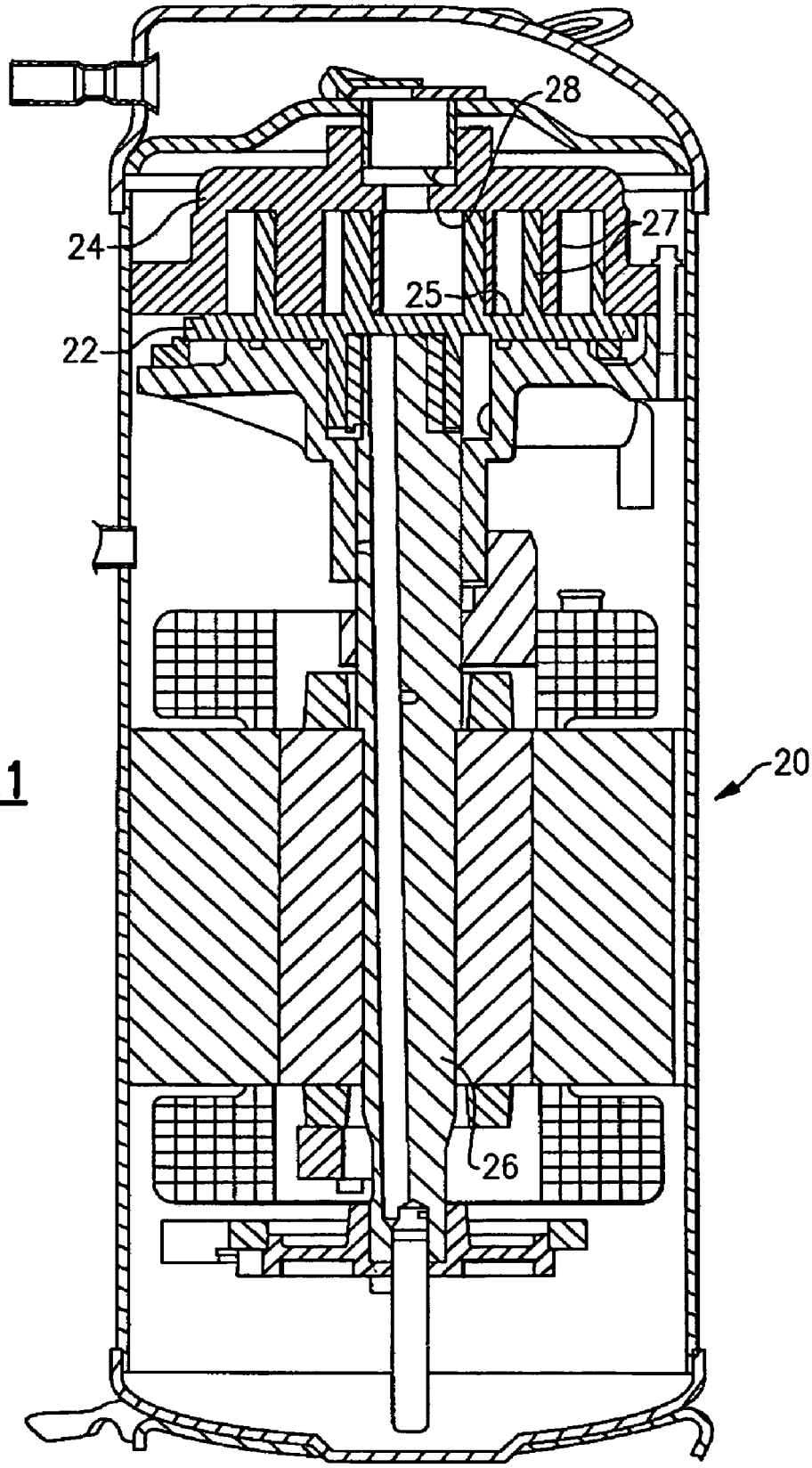
FIG. 1 is a cross-sectional view through a scroll compressor showing the invention.

A sealed compressor 20 is illustrated having a non-orbiting scroll member 24 and an orbiting scroll member 22. As known, each scroll includes a base 25 and a generally spiral wrap 27 extending from the base and interfitting with the other wrap to define compression chambers. A shaft 26 is driven by an electric motor. As known, when shaft 26 is driven to orbit, it causes orbiting scroll 22 to orbit relative to non-orbiting scroll 24.

Figure 2A:
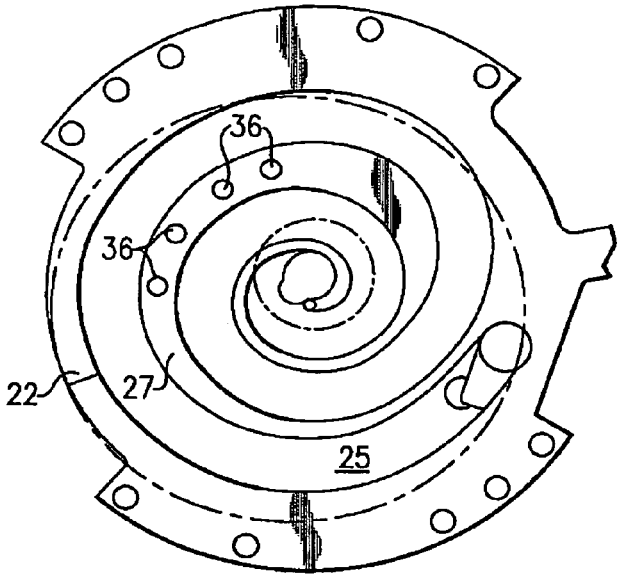
FIG. 2A is a perspective view showing an embodiment of the present invention.

As shown in FIG. 2A, a plurality of recesses 36 are shown on the tips of wrap 27 of the non-orbiting scroll 24. The recesses could also be on the wrap 27 of the orbiting scroll 22.

As can be appreciated, the wrap 27 is a hybrid wrap having a non-uniform cross-section. The recesses 36 are formed at a thicker portion of the wrap. However, the recesses can also be formed in the wraps that in general have a uniform thickness; in this case, it would be preferable to have wraps of sufficient thickness to place recesses on tips of the scroll wrap.

Figure 2B:
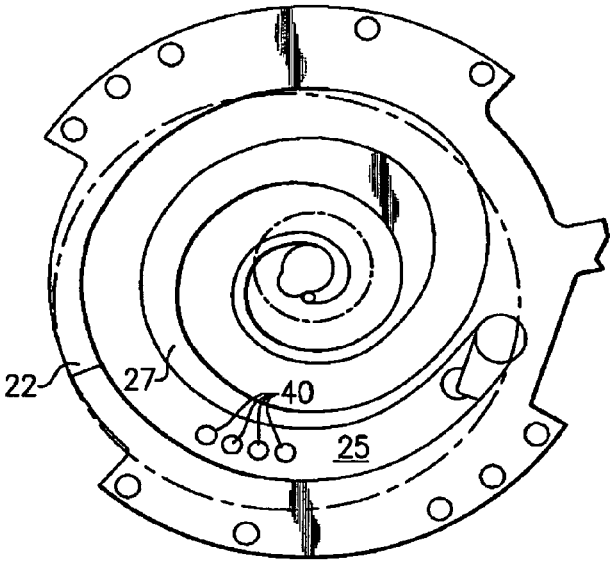
FIG. 2B is a perspective view showing another embodiment.

FIG. 2B shows another embodiment wherein the recesses 40 are formed in the base 28 of one of the fixed scroll member. Again, these recesses could be formed in either of the scroll members.

As can be appreciated from FIGS. 2A and 2B, the recesses 36 and 40 include a plurality of discrete and separate recesses. The recesses are circumferentially spaced along the direction of the hybrid wraps of the scroll members.

Figure 3:
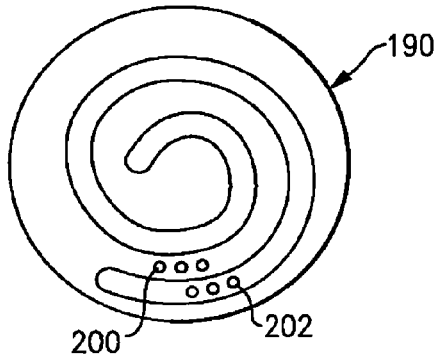
FIG. 3 shows further embodiments.

FIG. 3 shows another embodiment 190, wherein the orbiting scroll member includes the oil retention recesses. The recesses may be in the base of the orbiting scroll as shown at 200, or in the wrap as shown at 202. With any of the embodiments shown in FIGS. 2A, 2B, or 3, it should be understood that the oil retention recesses have a solid bottom, and do not include a supply or drain hole. Also, as can be appreciated from FIGS. 2A, 2B, and 3, many of the oil retention recesses are formed in a wrap, and the oil retention recesses formed in the base are at a location over which a wrap will pass.

Preferably, the recesses have a depth, which is significantly greater than the necessary oil film thickness such that the oil retained in the recesses will be sufficient to supply the oil film between the scroll members during "starved" lubricant operation. The oil is supplied and distributed in the interface due to a relative motion between the scroll elements.

In general, preferably it would require the recesses to have a depth of between 0.2 and 2.0 millimeters. While the recesses are illustrated as generally circular indentations, other shapes that would retain oil may also be utilized. In general, what is necessary is a recess that will capture oil and retain at least some part of the oil after the compressor shutdown, such that when the compressor is started up again this oil will lubricate the interface between the scroll elements immediately after the compressor is started up again. These oil retention features would serve a similar function during intermittent oil starvation when the compressor is running. In general the oil prevented from draining by having very small clearance between the scroll compressor elements either when compressor is operating or during shutdown, In addition, if the retention features are located on the scroll compressor surfaces that face upward, the gravity effects will not play a role in draining oil upon shutdown.

While a preferred embodiment has been disclosed, a worker in this art would recognize that many modifications would come within the scope of this invention. For that reason, the following claims should be studied to determine the true scope and content of this invention.

What is claimed is:

1. A scroll compressor comprising:

a first scroll member having a base and a generally spiral wrap extending from said base;

a second scroll member having a base and a generally spiral wrap extending from said base; said wraps of said first and second scroll members interfitting to define compression chambers;

an electric motor driving a shaft, said shaft causing said second scroll member to orbit relative to said first scroll member;

at least one oil retention recess formed on at least one of said first and second scroll members, said oil retention recesses being constructed to preserve a quantity of oil in said oil retention recess; and said at least one oil retention recess is formed in a tip of said wrap of at least one of said first and second scroll members, and there being a plurality of said oil recesses, with said plurality of oil recesses each being separate and isolated from the others of said plurality of oil recesses.

2. The scroll compressor as recited in claim 1, wherein said at least one oil retention recess is formed in a tip of said wrap of said first scroll member.

3. The scroll compressor as recited in claim 1, wherein said at least one oil retention recess is formed in a tip of said wrap of said second scroll member.

4. The scroll compressor as recited in claim 1, wherein said plurality of oil retention recess has a depth of between 0.2 and 2.0 millimeters.

5. The scroll compressor as recited in claim 1, wherein each of said plurality of oil retention recess has a circular shape.

6. The scroll compressor as recited in claim 1, wherein at least one of the said scroll members has non-uniform thickness.

7. The scroll compressor as recited in claim 1, wherein said plurality of oil retention recess being closed at a bottom surface, and not having a hole extending away from said oil retention recess which could drain oil.

8. The scroll compressor as recited in claim 1, wherein said oil retention recesses maintain a quantity of oil in said oil retention recesses after shutdown of the compressor, and against the force of gravity.

9. The scroll compressor as recited in claim 1, wherein said plurality of oil retention recesses are spaced circumferentially in a direction defined by said at least one scroll wrap.

10. A scroll compressor comprising:

a first scroll member having a base and a generally spiral wrap extending from said base;

a second scroll member having a base and a generally spiral wrap extending from said base; said wraps of said first and second scroll members interfitting to define compression chambers;

an electric motor driving a shaft, said shaft causing said second scroll member to orbit relative to said first scroll member;

at least one oil retention recess formed on at least one of said first and second scroll members, said oil retention recesses being constructed to preserve a quantity of oil in said oil retention recess, and said at least one oil retention recess being closed at a bottom surface, and not having a hole extending away from said oil retention recess which could drain oil; and said at least one oil retention recess is formed in a face of said base of at least one of said first and second scroll members, and said oil retention recess in said base being at a location over which a wrap of at least one of said first and second scroll members will pass, and there being a plurality of said oil recesses, with said plurality of oil recesses each being separate and isolated from the others of said plurality of oil recesses.

11. The scroll compressor as recited in claim 10, wherein said plurality of oil retention recess has a depth of between 0.2 and 2.0 millimeters.

12. The scroll compressor as recited in claim 10, wherein said plurality of oil retention recess has a circular shape.

13. The scroll compressor as recited in claim 10, wherein at least one of the said scroll members has non-uniform thickness.

* * * * *